US010657896B2

(12) United States Patent
Zeng et al.

(10) Patent No.: US 10,657,896 B2
(45) Date of Patent: May 19, 2020

(54) VOLTAGE COMPENSATION METHOD, COMPENSATION CIRCUIT, AND DISPLAY APPARATUS OF OLED

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventors: Yuchao Zeng, Guangdong (CN); Tai-jiun Hwang, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 286 days.

(21) Appl. No.: 15/735,881

(22) PCT Filed: Oct. 21, 2017

(86) PCT No.: PCT/CN2017/107182
§ 371 (c)(1),
(2) Date: Dec. 12, 2017

(87) PCT Pub. No.: WO2019/061605
PCT Pub. Date: Apr. 4, 2019

(65) Prior Publication Data

US 2020/0043412 A1 Feb. 6, 2020

(30) Foreign Application Priority Data

Sep. 27, 2017 (CN) ..... 2017 1 0896702

(51) Int. Cl.
*G09G 3/3258* (2016.01)

(52) U.S. Cl.
CPC ... *G09G 3/3258* (2013.01); *G09G 2320/0276* (2013.01); *G09G 2320/0673* (2013.01); *G09G 2330/021* (2013.01); *G09G 2360/16* (2013.01)

(58) Field of Classification Search
CPC ..... G09G 3/3258; G09G 2360/16; G09G 2320/0276; G09G 2320/0673; G09G 2330/021
See application file for complete search history.

(56) References Cited

U.S. PATENT DOCUMENTS

2006/0238551 A1 10/2006 Dalal
2008/0204438 A1 8/2008 Song et al.
(Continued)

FOREIGN PATENT DOCUMENTS

CN 1523564 A 8/2004
CN 1971683 A 5/2007
(Continued)

*Primary Examiner* — Andrew Sasinowski
(74) *Attorney, Agent, or Firm* — Hemisphere Law, PLLC; Zhigang Ma

(57) ABSTRACT

The disclosure discloses a voltage compensation method, a compensation circuit, and a display device of OLED. The OLED voltage compensation method includes detecting and acquiring a brightness value of each pixel of the OLED display panel; converting the brightness value into a voltage code according to a Gamma curve; and acquiring compensation data according to the driving voltage code, and compensating the driving voltage code according to the compensation data to drive the OLED display panel to display according to the compensated driving voltage code. In this way, the accuracy of the OLED voltage compensation can be improved, and the display effect of the OLED display panel can be improved.

14 Claims, 8 Drawing Sheets

(56) References Cited

U.S. PATENT DOCUMENTS

| | | | | |
|---|---|---|---|---|
| 2013/0120659 | A1* | 5/2013 | Park | G06T 5/001 348/674 |
| 2015/0130823 | A1* | 5/2015 | Kim | G09G 5/18 345/522 |

FOREIGN PATENT DOCUMENTS

| | | | |
|---|---|---|---|
| CN | 101281728 | A | 10/2008 |
| CN | 101354487 | A | 1/2009 |
| CN | 105243994 | A | 1/2016 |
| CN | 105280139 | A | 1/2016 |
| CN | 106782319 | A | 5/2017 |
| JP | H10153983 | A | 6/1998 |

* cited by examiner

VOLTAGE COMPENSATION METHOD, COMPENSATION CIRCUIT, AND DISPLAY APPARATUS OF OLED

RELATED APPLICATIONS

The present application is a National Phase of International Application Number PCT/CN2017/107182, filed Oct. 21, 2017, and claims the priority of China Application No. 201710896702.6, filed Sep. 27, 2017.

FIELD OF THE DISCLOSURE

The disclosure relates to the field of display technology, and in particular to a voltage compensation method, a compensation circuit, and a display device of OLED.

BACKGROUND

The Organic Light-Emitting Diode (OLED) display panel has the advantages such as self-luminous and large viewing angle, and has been widely used now. The relation between the brightness of the image used for the OLED display panel corresponded by the input signals is non-linear. Therefore, before the input signal drives the display of the OLED display panel, the input signal must be compensated to improve the image display effect of the OLED display panel.

In the long-term research and development, the inventor of the disclosure has found that in the prior art, the conversions of "grayscale data-driving voltage" and "driving voltage-grayscale data" are generally implemented by using a linear interpolation manner of fixed grayscale corresponding to the binding point. However, there is a certain deviation between the Gamma curve and the target Gamma curve acquired by linear interpolation, resulting in a certain deviation in the conversions of the "grayscale data-driving voltage" and the "driving voltage-grayscale data" and the low accuracy of the OLED voltage compensation.

SUMMARY

The technical problem to be solved by the disclosure is to provide a voltage compensation method, a compensation circuit, and a display device of OLED, so as to improve the accuracy of the OLED voltage compensation and improve the display effect of the OLED display panel.

To solve the above technical problem, a technical proposal of this disclosure is to provide an OLED voltage compensation circuit, configured to compensate a driving voltage of an OLED display panel, including a brightness detection unit configured to detect and acquire a brightness value of each pixel of the OLED display panel; an encoding unit configured to convert the brightness value acquired by the brightness detection unit into a driving voltage code according to a Gamma curve; a compensation unit configured to acquire compensation data according to the driving voltage code of the encoding unit and compensate the driving voltage code value according to the compensation data to drive display of the OLED display panel according to the compensated driving voltage code; the compensation data includes a voltage compensation code, and a encoding step of the voltage compensation code is the same as an encoding step of the driving voltage code.

To solve the above technical problem, another technical proposal of this disclosure is to provide an OLED voltage compensation circuit, configured to compensate a driving voltage of an OLED display panel, including: detecting and acquiring a brightness value of each pixel of the OLED display panel; converting the brightness value into a driving voltage code according to a Gamma curve; and acquiring compensation data according to the driving voltage code and compensating the driving voltage code according to the compensation data to drive the OLED display panel to display according to the compensated driving voltage code.

To solve the technical problem, further another technical proposal of this disclosure is to provide a display apparatus including the voltage compensation circuit, the driving circuit, and the display panel of OLED. The OLED voltage compensation circuit compensates a driving voltage of the OLED display panel, and the driving circuit drives the OLED display panel to work according to the driving voltage code compensated by the OLED voltage compensation circuit.

The beneficial effect of the disclosure is that, different from the prior art, the OLED voltage compensation method in the embodiment of the disclosure is used to compensate the driving voltage of the OLED display panel. The method firstly detects and acquires a brightness value of each pixel of the OLED display panel, and converts the brightness value into a voltage according to a Gamma curve, and then acquires voltage compensation data according to the voltage and compensates the voltage according to the voltage compensation data, so as to drive the OLED display panel to display according to the compensated voltage. In this way, the OLED voltage compensation method of the embodiment converts the brightness value of the pixel into the corresponding voltage code according to the Gamma curve, and directly drives the display of the OLED display panel after the voltage code is compensated by the compensation data without converting the compensated voltage into a grayscale value again, so the deviations brought from the conversion of "voltage-gradation" can be reduced, thereby improving the accuracy of the OLED voltage compensation and the display effect of the OLED display panel.

DETAILED DESCRIPTION OF PREFERRED EMBODIMENTS

Figure 1:
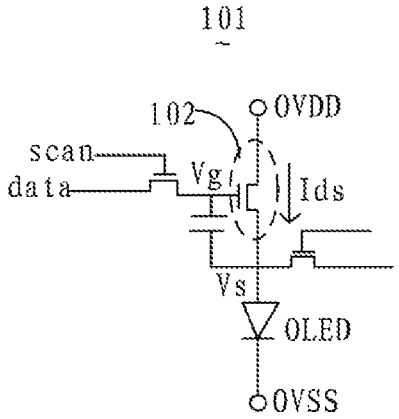
FIG. 1 is a circuit diagram of a pixel of an OLED display panel.

The pixel circuit 101 of the OLED display panel as shown in FIG. 1, the brightness of the OLED is proportional to the expected current $I_{OLED}$, there $L=\eta*I_{OLED}$, and $\eta$ is a luminous efficiency of the OLED; the driving TFT 102 operates in a saturation region and controls the current $I_{ds}=k(V_g-V_s-Vth)^2$ through the gate voltage $V_g$ thereof, and the OLED is connected in series with the driving TFT 102, therefore, $I_{ds}=I_{OLED}$. It can be seen that for each pixel, the differences of the brightness ratio coefficient k of the threshold voltage Vth of the driving TFT 102 and the OLED luminous efficiency $\eta$ will lead to the control current $I_{ds}$ difference existing between the pixels in the situation of the same $V_g$ and $V_s$, and the difference of OLED brightness L is mainly reflected in the Vth and brightness-related scale factor of the driving TFT 102. Therefore, in order to reduce the difference of the OLED brightness $\eta*k$ of each pixel, the uniformity of the OLED brightness L can be compensated by the voltage compensation of the driving voltage and the compensation of the brightness scale factor.

Figure 2:
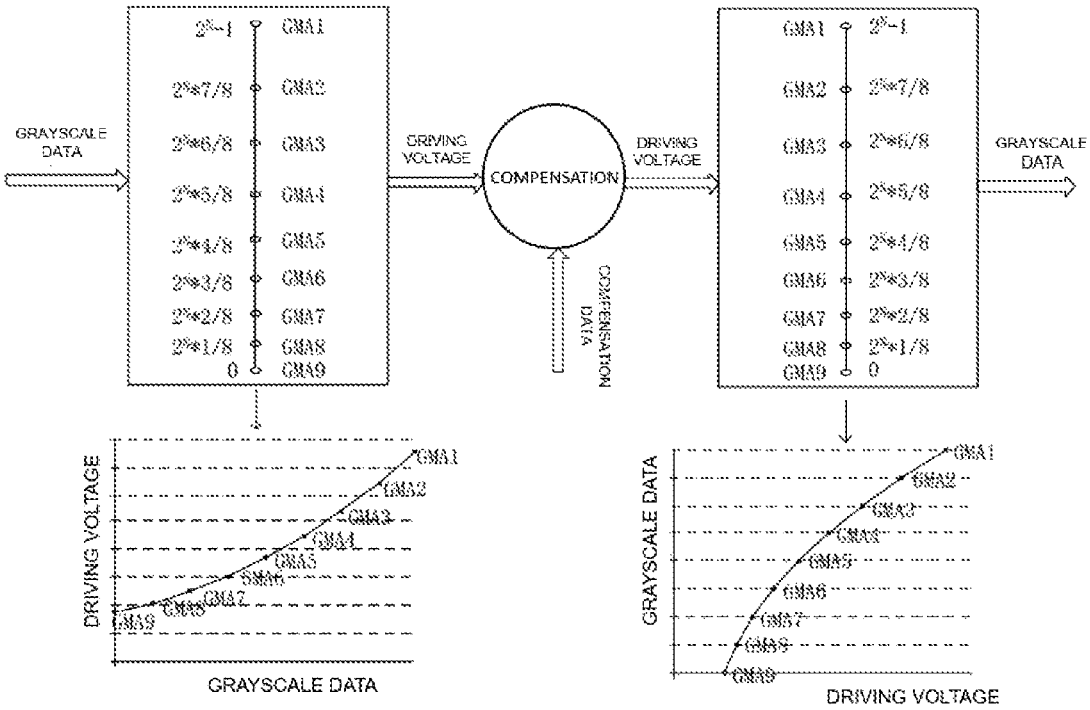
FIG. 2 is a schematic diagram of performing an OLED voltage compensation by linear interpolation.

As shown in FIG. 2, The grayscale data of the OLED display panel is implemented to the conversions of "grayscale data-driving voltage" and "driving voltage-grayscale data" by using a linear interpolation manner of fixed grayscale data corresponding to the binding point voltages GMA1-GMA9. The compensation data is stored as voltage. A certain deviation exists between the curves of "grayscale data-driving voltage" and "driving voltage-grayscale data" that is, the Gamma curve and the target Gamma curve, acquired by linear interpolation, and the deviations of the grayscale data after converting the Gamma curve twice will be further expanded, so the compensation accuracy of voltage compensation in this way is not high.

Figure 3:
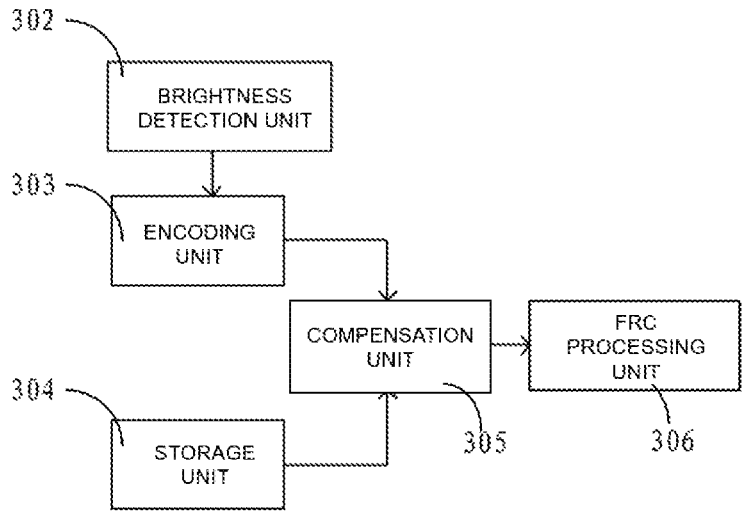
FIG. 3 is a schematic structural view of a first embodiment of an OLED voltage compensation circuit of the disclosure.
Figure 4:
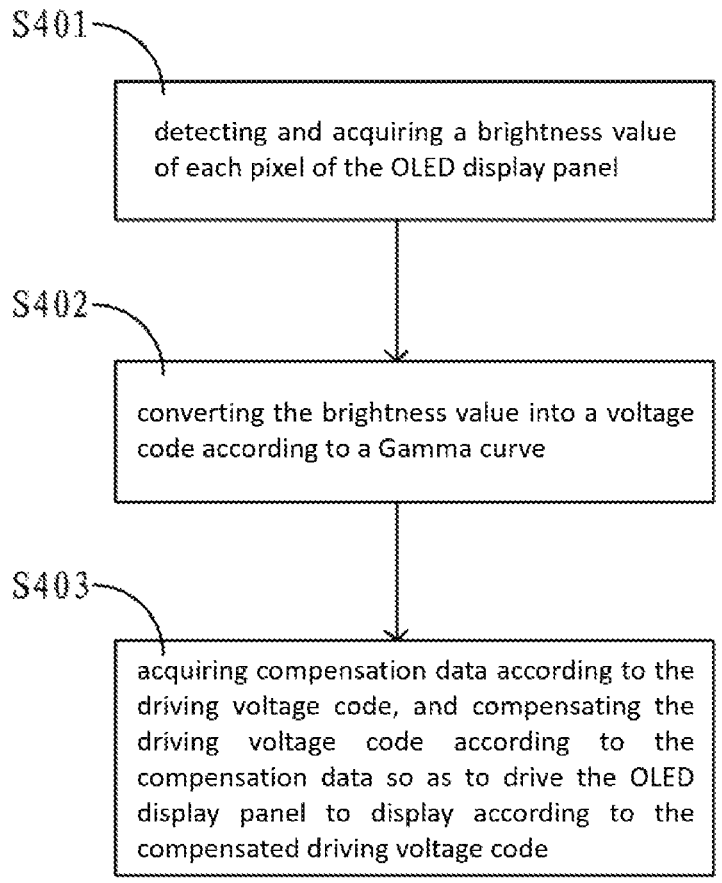
FIG. 4 is a schematic flow diagram of a first embodiment of the OLED voltage compensation method of the disclosure.

In view of the above technical problems, the disclosure provides an OLED voltage compensation circuit, as shown in FIG. 3, the OLED voltage compensation circuit 301 in this embodiment includes a brightness detection unit 302, an encoding unit 303, a storage unit 304, a compensation unit 305, and an FRC processing unit 306. This embodiment also provides an OLED voltage compensation method, as shown in FIG. 4, the OLED voltage compensation method in this embodiment adopts the OLED voltage compensation circuit 301 in FIG. 3 to compensate the driving voltage of the OLED display panel, thereby improving the accuracy of the OLED voltage compensation and the display effect of the OLED display panel. The OLED voltage compensation method in this embodiment includes the following steps:

S401: detecting and acquiring a brightness value of each pixel of the OLED display panel.

Detect and acquire the brightness value of each pixel of an OLED display panel by the brightness detection unit 302; each of the pixels described in this embodiment refers to each sub-pixel, and the OLED voltage compensation of this embodiment is suitable for OLED voltage compensation of each sub-pixel.

S402: converting the brightness value into a voltage code according to a Gamma curve.

S403: acquiring compensation data according to the driving voltage code, and compensating the driving voltage code according to the compensation data to drive the OLED display panel to display according to the compensated driving voltage code.

The compensation unit 305 respectively acquires the compensation data and the driving voltage code from the storage unit 304 and the encoding unit 303 and compensates the voltage code according to the compensation data to drive the OLED display panel to display according to the compensated driving voltage code.

Different from the prior art, the OLED voltage compensation method of the embodiment converts the brightness value of the pixel into the corresponding voltage code according to the Gamma curve, and directly drives the display of the OLED display panel after the voltage code is compensated by the compensation data without converting the compensated voltage into grayscale again, so the deviations brought from the conversion of "voltage-gradation" can be reduced, thereby improving the accuracy of the OLED voltage compensation and the display effect of the OLED display panel.

Figure 5:
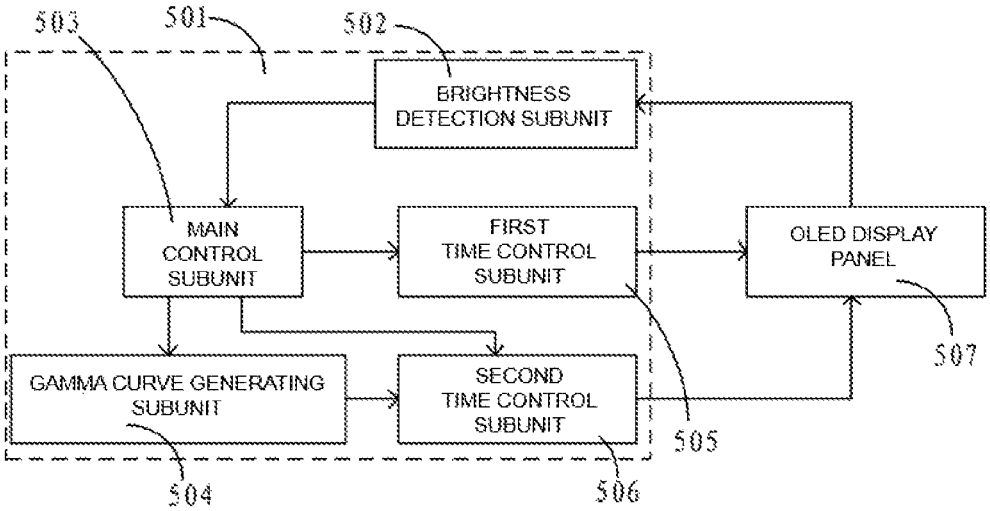
FIG. 5 is a schematic structural view of a Gamma curve generating unit of the embodiment of FIG. 3.
Figure 6:
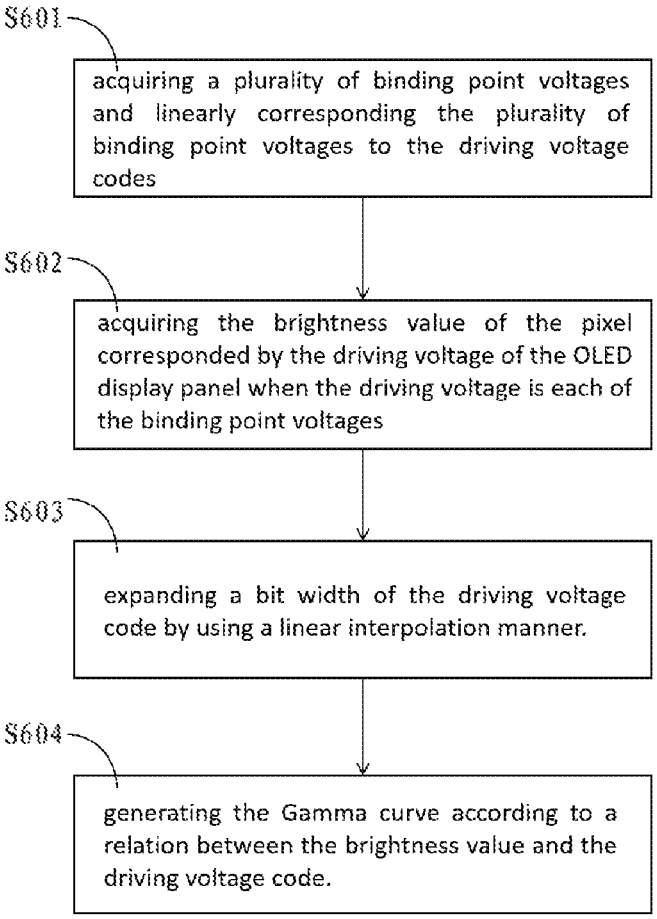
FIG. 6 is a flowchart of a method for generating a Gamma curve according to the embodiment of FIG. 3.

The Gamma curve coordinates in this embodiment include a driving voltage code set on a horizontal axis and a brightness value set on a vertical axis, as shown in FIGS. 5 and 6, FIG. 5 is a schematic structural view of a Gamma curve generating unit of the embodiment of FIG. 3; FIG. 6 is a flowchart of a method for generating a Gamma curve in the embodiment of FIG. 3. The generation circuit 501 of the Gamma curve in this embodiment includes a brightness detection subunit 502, a main control subunit 503, a Gamma curve generating subunit 504, a first timing control subunit 505, and a second timing control subunit 506. The Gamma curve generation method in this embodiment includes the following steps:

S601: acquiring a plurality of binding point voltages and linearly corresponding the plurality of binding point voltages to the driving voltage codes.

Figure 7A:
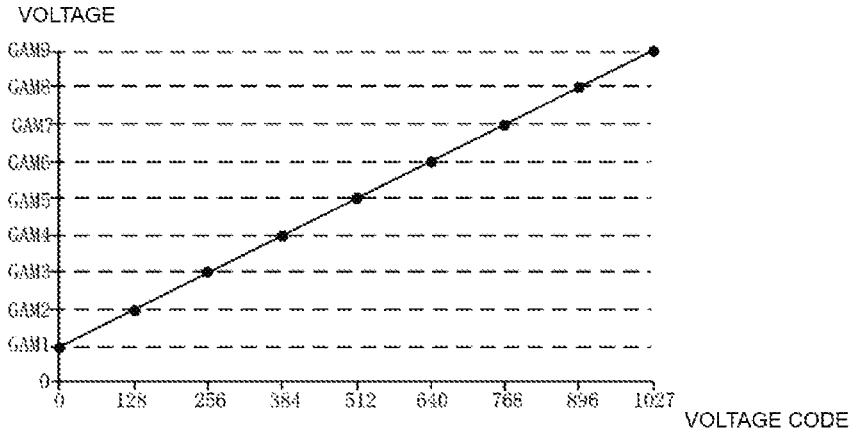
FIG. 7A is a curve diagram of a linear relation of a plurality of the binding point voltages and the driving voltages in the embodiment of FIG. 6.

The main control subunit 503 acquires a plurality of binding point voltage, specifically, a plurality of binding point voltages GMA1-GMA9, and linearly correspond the binding point voltages GMA1-GMA9 to the driving voltage codes, as shown in FIG. 7A.

In this embodiment, the binding point voltages GMA1-GMA9 are linearly corresponded by the driving voltage codes, so that the encoding step of the driving voltage code can be constant. For example, when the driving voltage code is encoded as a 10-bit code, the encoding step length is (GMA9-GMAA1)/1024.

S602: acquiring the brightness value of the pixel corresponded by the driving voltage of the OLED display panel 507 when the driving voltage is each of the binding point voltages GMA1-GMA9.

Figure 7B:
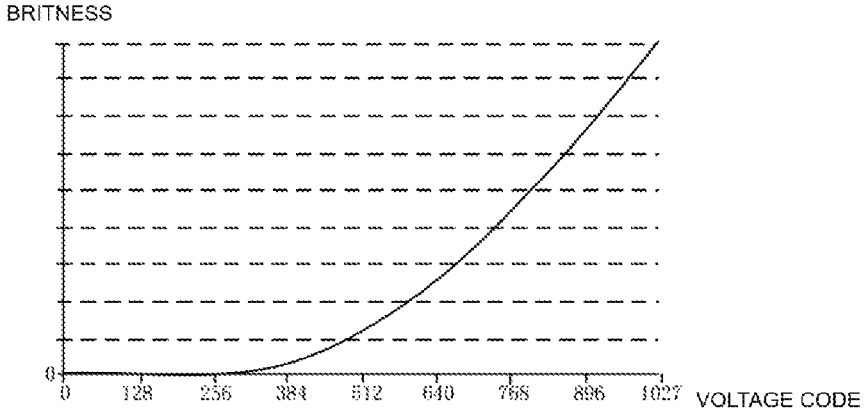
FIG. 7B is a curve diagram of a relation of the voltage codes corresponding to the plurality of the driving bonding point voltages and the corresponding brightness values in the embodiment of FIG. 6.

Specifically, the first timing control subunit 505 transmits the plurality of the binding point voltages GMA1-GMA9 acquired by the main control subunit 503 respectively to the OLED display panel 507 for display, and at the same time, the brightness detection subunit 502 acquires the plurality of the brightness values when the OLED display panel is driven by the plurality of the binding point voltages GMA1-GMA9 respectively, and the brightness values are transferred to the main control subunit 503; the main control subunit 503 can acquire the relation between the driving voltage codes corresponded by the plurality of the binding point voltages GMA1-GMA9 and the brightness values corresponding thereto, as shown in FIG. 7B.

S603: expanding a bit width of the driving voltage code by using a linear interpolation manner.

Figure 7C:
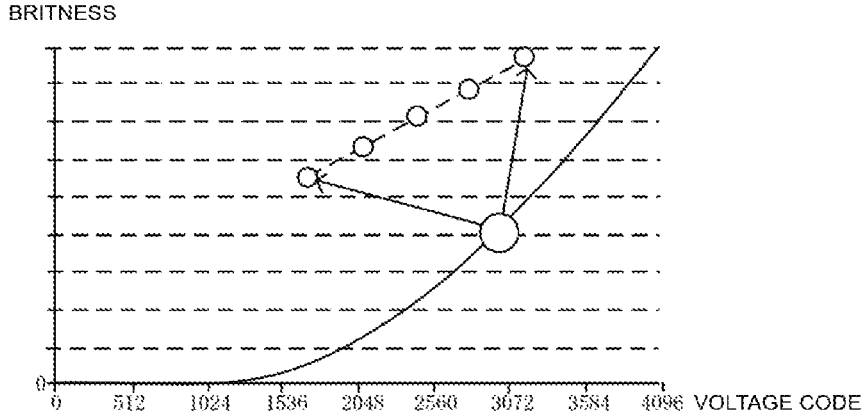
FIG. 7C is a schematic diagram of a curve after the bit width of the driving voltage code is expanded in the embodiment of FIG. 7B.

The main control subunit 503 expands the bit width of the driving voltage code by linear interpolation. For example, if the bit width is expanded from 10-bit to 12-bit, as shown in FIG. 7C, the number that the brightness values corresponds to the drive voltage code after the bit width of the code is expanded from 1024 to 4096, thereby further enhancing the brightness value and the corresponding accuracy of driving voltage code, so as to improve the accuracy of the Gamma curve. Of course, the bit width of the driving voltage code can be expanded according to the specific requirements of the driving voltage compensation accuracy.

S604: generating the Gamma curve according to a relation between the brightness value and the driving voltage code.

The Gamma curve in this embodiment indicates the brightness value and the driving voltage code. In the subsequent data processing, the OLED display panel 507 is directly driven with the driving voltage code for display without the conversion of "voltage-grayscale", so the deviations brought from the conversion of "voltage-grayscale" can be reduced, thereby improving the accuracy of the OLED voltage compensation and the display effect of the OLED display panel.

The compensation data in this embodiment is the voltage compensation code, and the compensation data acquired according to the driving voltage code includes acquiring the voltage compensation codes corresponded by the compensation data according to the driving voltage code, and an encoding step of the voltage compensation code is the same as an encoding step of the driving voltage code.

Figure 8A:
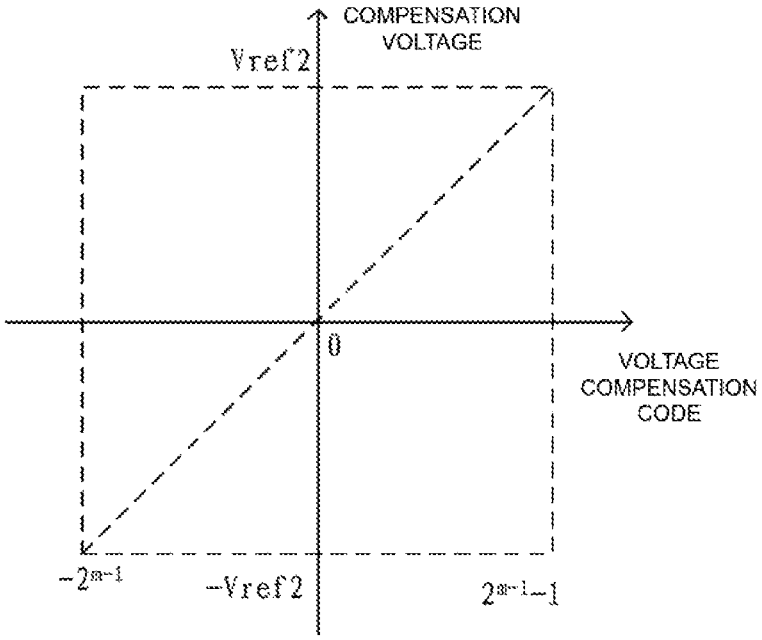
FIG. 8A is a schematic diagram of a voltage compensation code in the embodiment of FIG. 6.

From the above analysis, in order to improve the accuracy of the OLED voltage compensation, the compensated driving voltage code value directly drives the OLED display panel to display. When compensating the driving voltage code, in order to improve the compensation efficiency, the voltage compensation code is used to compensate the driving voltage code, and in order to improve the compensation accuracy, the encoding step of the voltage compensation code is the same as the encoding step of the driving voltage code. As shown in FIG. 8A, the coding range of the voltage compensation code is −Vref2~Vref2, the step size is $$\frac{Vref2}{2^{m-1}},$$

and the bit width is m bit. The encoding step of the voltage compensation code is the same as the encoding step of the drive voltage code. There are:

$$\frac{GMA9 - GMA1}{2n} = \frac{Vref2}{2^{m-1}}, \text{ that is, } \frac{GMA9 - GMA1}{Vref2} = 2^{n-m+1}.$$

Figure 8B:
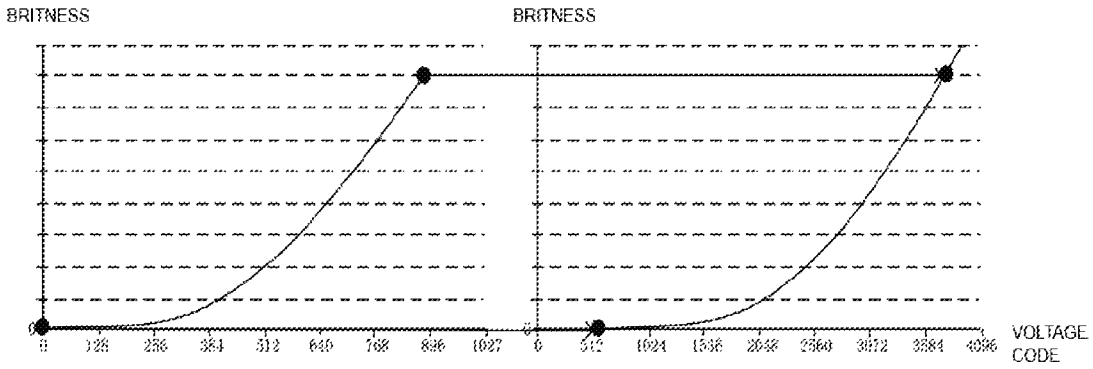
FIG. 8B is another schematic diagram of a curve after the bit width of the driving voltage is expanded in the embodiment of FIG. 7B.
Figure 9:
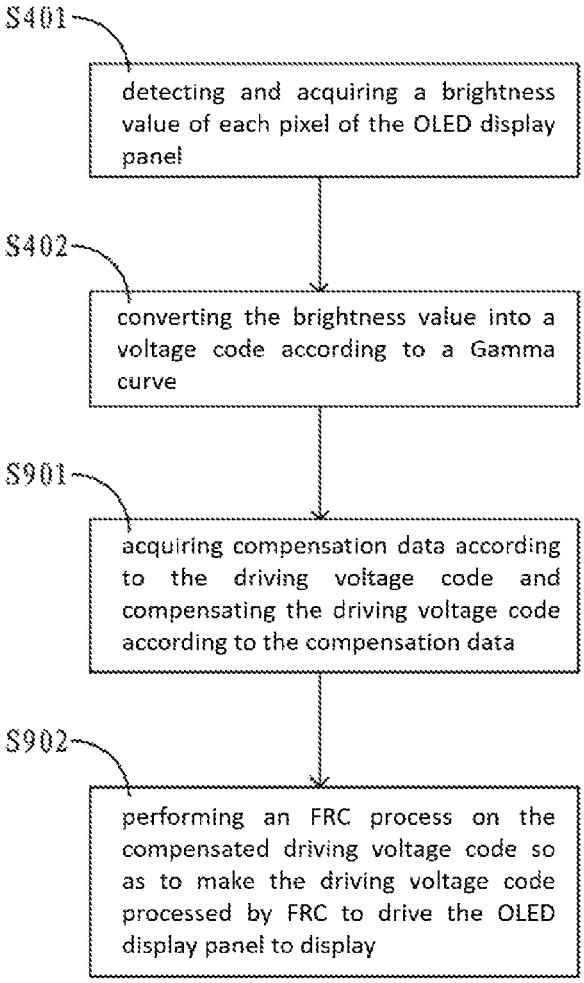
FIG. 9 is a flow chart of a second embodiment of the OLED voltage compensation method of the disclosure.

In this embodiment, a Gamma curve is generated by a method in which the target brightness is equal to the time brightness, assuming that the range of the Gamma curve corresponding to the driving voltage code is [CD1, CD2], as shown in FIG. 8B; While meeting $2^{m-1}$<CD1 and $2^{m-1}$<($2^n$−CD2) in the case, the pixel voltage compensation will not overflow, and the high and low brightness values can be completely compensated.

Of course, in other embodiments, the compensation data may also include the brightness-related scale factor of the OLED. The voltage compensation code corresponding to the compensation data may be acquired according to the driving voltage code to compensate the driving voltage code by using the voltage compensation code, and the encoding step of the voltage compensation code is the same as the encoding step of the driving voltage code.

This embodiment can also provide a certain margin for the voltage compensation by designing the binding point voltages GMA1-GMA9 to improve the compensation range of the low brightness and high brightness of the pixel.

The disclosure further provides an OLED voltage compensation method of the second embodiment, the OLED voltage compensation method disclosed in the embodiments will be described on the basis of the OLED voltage compensation method of the above embodiments. Step S901 in this embodiment replaces step S403 in the above embodiment.

S901: acquiring compensation data according to the driving voltage code and compensating the driving voltage code according to the compensation data.

S902: performing a frame rate conversion (FRC) process on the compensated driving voltage code so as to make the driving voltage code processed by FRC to drive the OLED display panel to display.

The FRC processing unit 306 acquires the compensated driving voltage code from the compensation unit 304 and performs the FRC process on the compensated driving voltage, so that the driving voltage processed by FRC drives the OLED display panel 507 to display.

The FRC process inserts a new image data generated after the calculation into the image data of the original signal source to improve the accuracy of the driving voltage compensation and make the display of the OLED display smoother.

The disclosure further provides an OLED voltage compensation circuit. As shown in FIG. 3, the OLED voltage compensation circuit 301 of the present embodiment compensates the driving voltage of the OLED display panel by adopting the method of the above embodiment. The OLED voltage compensation circuit 301 in this embodiment includes a brightness detection unit 302, an encoding unit 303, a storage unit 304, a compensation unit 305, and an FRC processing unit 306. This embodiment further provides an OLED voltage compensation method, and the brightness detection unit 302 is configured to detect and acquire the brightness value of each pixel of the OLED display panel; the encoding unit 303 is configured to convert the brightness value acquired by the brightness detection unit 302 according to the Gamma curve; The storage unit 304 is configured to acquire the compensation data according to the driving voltage code of the encoding unit 303 and compensate the driving voltage encoding value according to the compensation data, so as to drive the OLED display panel display according to the compensated driving voltage code.

Different from the prior art, the encoding unit 303 of the OLED voltage compensation circuit 301 in this embodiment converts the brightness value of the pixel into the corresponding voltage code according to the Gamma curve; and directly drives the OLED display panel to display after the voltage codes are compensated by the compensation data without converting the compensated voltage into grayscale again, so the deviations brought from the conversion of "voltage-gradation" can be reduced, thereby improving the accuracy of the OLED voltage compensation and the display effect of the OLED display panel.

Optionally, the OLED voltage compensation circuit 301 of this embodiment further includes an FRC processing unit 306. The FRC processing unit 306 acquires the compensated driving voltage code from the compensation unit 304 and performs the FRC process on the compensated driving voltage, so that the driving voltage code processed by FRC drives the OLED display panel to display, thereby improving the accuracy of the OLED voltage compensation and the display effect of the OLED display panel.

Figure 10:
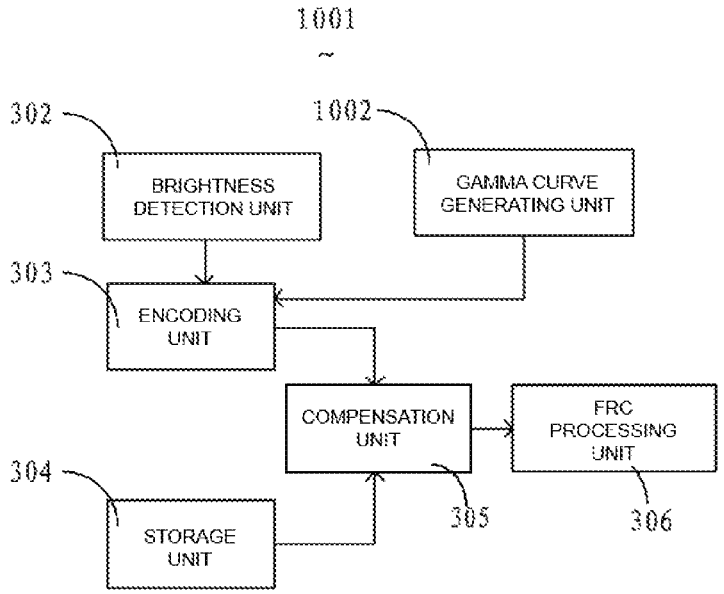
FIG. 10 is a schematic structural view of the second embodiment of the OLED voltage compensation circuit of the disclosure.

The disclosure further provides an OLED voltage compensation circuit of the second embodiment, the OLED voltage compensation circuit disclosed in the embodiment will be described on the basis of the OLED voltage compensation circuit of the above embodiment. As shown in FIG. 10, an OLED voltage compensation circuit 1001 of this embodiment further includes a Gamma curve generator 1002, the Gamma curve generating unit 1002 is configured to acquire a plurality of binding point voltages and linearly correspond the plurality of the binding point voltages to the driving voltage codes; the Gamma curve generating unit 1002 acquires the brightness value corresponded by the driving voltage of the OLED display panel when the driving voltage is each of the binding point voltages, and expands a bit width of the driving voltage code by using a linear interpolation manner, and generates the Gamma curve according to a relation between the brightness value and the driving voltage code. The encoding unit 303 converts the brightness value acquired by the brightness detection unit 302 into the driving voltage code according to the Gamma curve generated by the Gamma curve generating unit 1002, so that the compensation unit 304 acquires the voltage compensation data according to the driving voltage code.

Specifically, a specific structure of the Gamma curve generating unit 1002 in this embodiment is shown in FIG. 5 and will not be described herein. The Gamma curve generating unit 1002 in this embodiment can expand the bit width of the driving voltage code and improve the accuracy of the Gamma curve. The brightness detection unit 302 and the brightness detection subunit 502 may be the same circuit.

Figure 11:
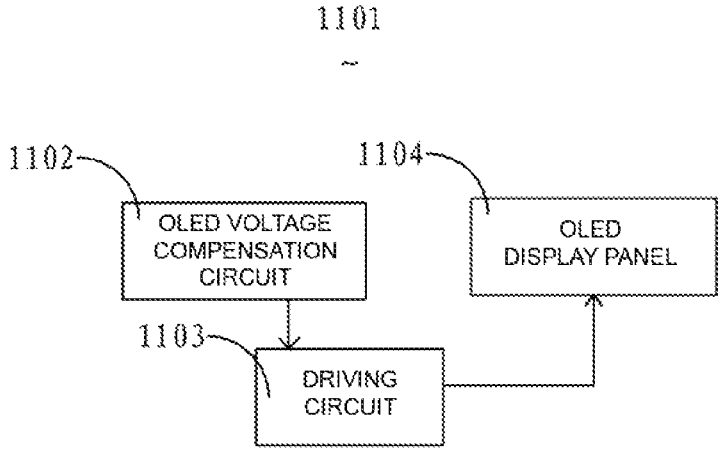
FIG. 11 is a structural diagram of an embodiment of the disclosure.

The disclosure further provides a display apparatus, as shown in FIG. 11, the display apparatus 1101 of this embodiment includes an OLED voltage compensation circuit 1102, a driving circuit 1103, and an OLED display panel 1104. The OLED voltage compensation circuit 1102 compensates the driving voltage of the OLED display panel 1104, and the driving circuit 1103 drives the OLED display panel 1104 to work according to the driving voltage code compensated by the OLED voltage compensation circuit 1102. The structure and the compensation principle of the OLED voltage compensation circuit 1102 are described in detail in the above embodiments and will not be described herein.

Different from the prior art, the OLED voltage compensation circuit 1102 of the embodiment converts the brightness value of the pixel into the corresponding voltage code according to the Gamma curve, and directly drives the OLED display panel 1104 to display after the voltage code is compensated by the compensation data without converting the compensated voltage code into grayscale again, so the deviations brought from the conversion of "voltage-grayscale" can be reduced, thereby improving the accuracy of the OLED voltage compensation and the display effect of the OLED display panel 1104.

Above are only embodiments of the disclosure is not patented and therefore limit the scope of the disclosure, the use of any content of the present specification and drawings made equivalent or equivalent structural transformation process, either directly or indirectly related to the use of other technologies areas are included in the same way the scope of the patent protection of the disclosure.

What is claimed is:

1. An OLED voltage compensation circuit, configured to compensate a driving voltage of an OLED display panel, comprising:

a brightness detection unit, configured to detect and acquire a brightness value of each pixel of the OLED display panel;

an encoding unit, configured to convert the brightness value acquired by the brightness detection unit into a driving voltage code according to a Gamma curve; and a compensation unit, configured to acquire compensation data according to the driving voltage code of the encoding unit and compensate the driving voltage code value according to the compensation data to drive display of the OLED display panel according to the compensated driving voltage code;

wherein the compensation data comprises a voltage compensation code, and an encoding step of the voltage compensation code is the same as an encoding step of the driving voltage code;

wherein the compensation data further comprises a brightness-related scale factor; the compensation unit acquires the voltage compensation code and the brightness-related scale factor corresponding to the compensation data according to the driving voltage code, so as to compensate the driving voltage code by using the voltage compensation code and the brightness-related scale factor.

2. The voltage compensation circuit according to claim 1, wherein the voltage compensation circuit further comprises a Gamma curve generating unit, wherein coordinates of the Gamma curve comprise a driving voltage code set on a horizontal axis and the brightness value set on a vertical axis, and the Gamma curve generating unit is configured to acquire a plurality of binding point voltage and linearly correspond the plurality of binding point voltage to the driving voltage code; the Gamma curve generating unit acquires the brightness value corresponded by the driving voltage of the OLED display panel when the driving voltage is each of the binding point voltages, expands a bit width of the driving voltage code by using a linear interpolation manner, and generates the Gamma curve according to a relation between the brightness value and the driving voltage code;

wherein the encoding unit converts the brightness value acquired by the brightness detection unit into the driving voltage code according to the Gamma curve generated by the Gamma curve generating unit, so that the compensation unit acquires the voltage compensation data according to the driving voltage code.

3. The voltage compensation circuit according to claim 2, wherein the compensation circuit further comprises an FRC processing unit, the FRC processing unit is used to perform an FRC process to the driving voltage code compensated by the compensation unit, so that the driving voltage code processed by FRC drives the OLED display panel to display.

4. The voltage compensation circuit according to claim 2, wherein the Gamma curve generating unit expands the bit width of the driving voltage by 2 bits.

5. An OLED voltage compensation method, configured to compensate a driving voltage of an OLED display panel, comprising:

detecting and acquiring a brightness value of each pixel of the OLED display panel;

converting the brightness value into a driving voltage code according to a Gamma curve; and acquiring compensation data according to the driving voltage code, and compensating the driving voltage code according to the compensation data to drive the OLED display panel to display according to the compensated driving voltage code;

performing an FRC process to the driving voltage code, so that the driving voltage code processed by FRC drives the OLED display panel to display.

6. The voltage compensation method according to claim 5, wherein coordinates of the Gamma curve comprise a driving voltage code set on a horizontal axis and the brightness value set on a vertical axis, and the method of generating the Gamma curve comprises:

acquiring a plurality of binding point voltages and linearly corresponding the plurality of binding point voltages to the driving voltage codes;

acquiring the brightness value of the pixel corresponded by the driving voltage of the OLED display panel when the driving voltage is each of the binding point voltages;

expanding a bit width of the driving voltage code by using a linear interpolation manner; and generating the Gamma curve according to a relation between the brightness value and the driving voltage code.

7. The voltage compensation method according to claim 6, wherein the bit width of the driving voltage is expanded by 2 bits.

8. The voltage compensation method according to claim 6, wherein the compensation data comprises a voltage compensation code, and the compensation data acquired according to the driving voltage code comprises:

acquiring the voltage compensation code corresponded by the compensation data according to the driving voltage code to compensate the driving voltage code by using the voltage compensation code, wherein an encoding step of the voltage compensation code is the same as an encoding step of the driving voltage code.

9. The voltage compensation method according to claim 8, wherein the compensation data further comprises a brightness-related scale factor; and the compensation data acquired according to the driving voltage code comprises:

acquiring the voltage compensation code and the brightness-related scale factor corresponded by the compensation data according to the driving voltage code, so as to compensate the driving voltage code by using the voltage compensation code and the brightness-related scale factor.

10. A display apparatus comprising a voltage compensation circuit, a driving circuit, and a display panel of OLED, wherein the OLED voltage compensation circuit compensates a driving voltage of the OLED display panel, and the driving circuit drives the OLED display panel to work according to the driving voltage code compensated by the OLED voltage compensation circuit;

wherein the voltage compensation circuit comprises:

a brightness detection unit, configured to detect and acquire a brightness value of each pixel of the OLED display panel;

an encoding unit, configured to convert the brightness value acquired by the brightness detection unit into a driving voltage code according to a Gamma curve; and a compensation unit, configured to acquire compensation data according to the driving voltage code of the encoding unit and compensate the driving voltage code value according to the compensation data to drive display of the OLED display panel according to the compensated driving voltage code;

wherein the compensation data comprises a voltage compensation code, and an encoding step of the voltage compensation code is the same as an encoding step of the driving voltage code.

11. The display apparatus according to claim 10, wherein the voltage compensation circuit further comprises a Gamma curve generating unit, coordinates of the Gamma curve comprise a driving voltage code set on a horizontal axis and the brightness value set on a vertical axis, and the Gamma curve generating unit is configured to acquire a plurality of binding point voltage and linearly correspond the plurality of binding point voltage to the driving voltage code; the Gamma curve generating unit acquires the driving voltage of the OLED display panel as the respective binding a corresponding brightness value at a voltage point, and expands a bit width of the driving voltage code by using a linear interpolation manner; and generates the Gamma curve according to a relation between the brightness value and the driving voltage code;

wherein the encoding unit converts the brightness value acquired by the brightness detection unit into the driving voltage code according to the Gamma curve generated by the Gamma curve generating unit, so that the compensation unit acquires the voltage compensation data according to the driving voltage code.

12. The display apparatus according to claim 11, wherein the compensation circuit further comprises a FRC processing unit used to perform an FRC process to the driving voltage code compensated by the compensation unit, so that the driving voltage code processed by FRC drives the OLED display panel to display.

13. The display apparatus according to claim 11, wherein the Gamma curve generating unit expands the bit width of the driving voltage by 2 bits.

14. The display apparatus according to claim 10, wherein the compensation data further comprises a brightness-related scale factor; acquiring the voltage compensation code and the brightness-related scale factor corresponded by the compensation data according to the driving voltage code, so as to compensate the driving voltage code by using the voltage compensation code and the brightness-related scale factor.

* * * * *